United States Patent [19]

Chibana

[11] 4,296,663

[45] Oct. 27, 1981

[54] ELECTRONIC MUSICAL INSTRUMENT

[75] Inventor: Masanobu Chibana, Hamamatsu, Japan

[73] Assignee: Nippon Gakki Seizo Kabushiki Kaisha, Japan

[21] Appl. No.: 75,227

[22] Filed: Sep. 13, 1979

[30] Foreign Application Priority Data

Sep. 14, 1978 [JP] Japan ..... 53-113735
Sep. 14, 1978 [JP] Japan ..... 53-127397[U]

[51] Int. Cl.[3] ..... G10H 1/00

[52] U.S. Cl. ..... 84/1.01; 84/1.13; 84/1.19; 84/1.26

[58] Field of Search ..... 84/1.01, 1.22, 1.19, 84/1.26, 1.13

[56] References Cited

U.S. PATENT DOCUMENTS 3,535,969 10/1970 Bunger ..... 84/1.19
3,943,456 3/1976 Luce ..... 84/1.01
4,109,208 8/1978 Tomisawa et al. ..... 328/13

*Primary Examiner*—J. V. Truhe
*Assistant Examiner*—Forester W. Isen
*Attorney, Agent, or Firm*—Lerner, David, Littenberg & Samuel

[57] ABSTRACT

In an electronic musical instrument, two or more pulse signals different in phase are generated each having a frequency corresponding to the tonal pitch of an operated key, an envelope waveshape is read out upon every key operation, sampling is executed on the envelope waveshape by means of these pulse signals, and polarities of sample values are converted in reference to these pulse signals for generation of a corresponding musical tone waveshape. Minimized use of arithmetic circuits such as adders and multipliers greatly reduces production cost whilst assuring generation of a wide variety of colorful, noise-free musical tones. By addition of a slope conversion circuit, abrupt shift in the generated musical tone waveshapes can well be disappeared.

10 Claims, 25 Drawing Figures

Fig. 4
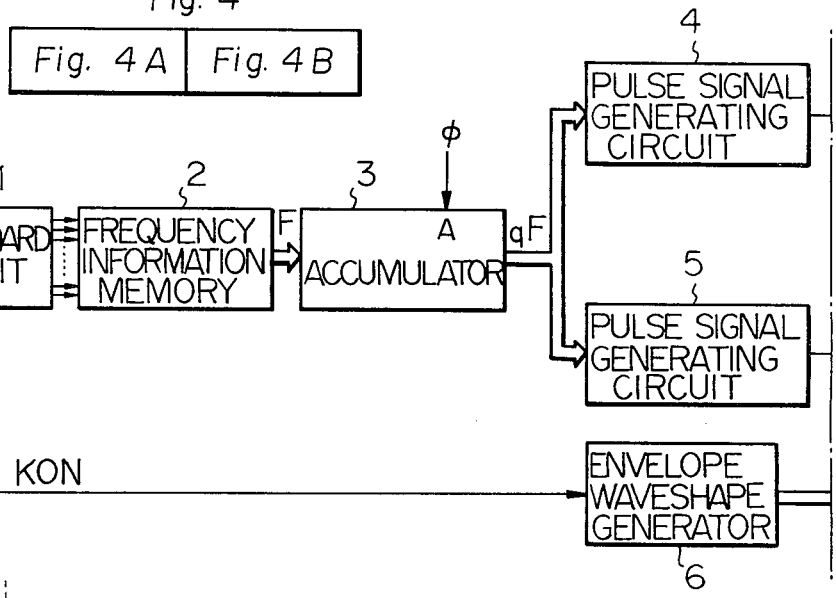
Fig. 4A
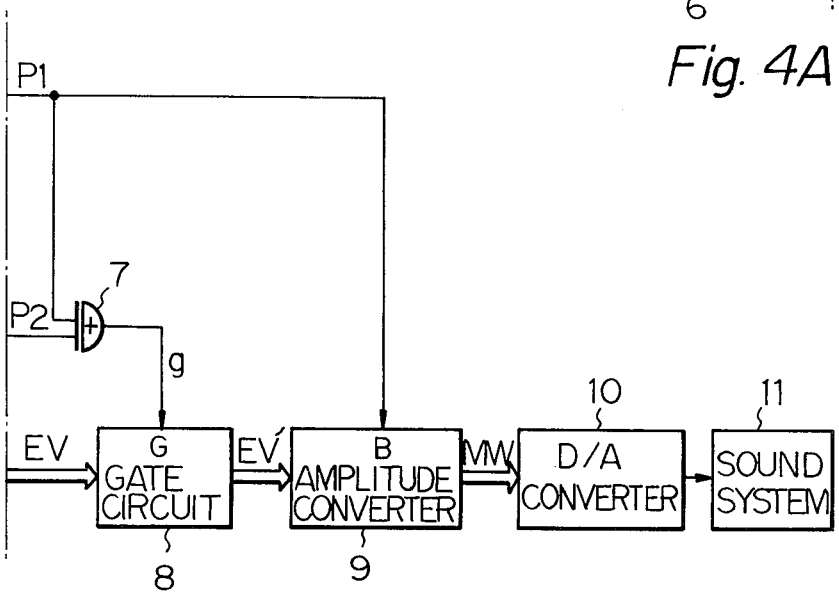
Fig. 4B

| Fig. 10A | Fig. 10B |
|---|---|

| Fig. 12 A | Fig. 12 B |
|---|---|

ELECTRONIC MUSICAL INSTRUMENT

BACKGROUND OF THE INVENTION

The present invention relates to an electronic musical instrument, and more particularly relates to an electronic musical instrument which is capable of generating musical tones without use of any intricate arithmetic circuit or circuits including a number of multipliers and/or adders.

A wide variety of electronic musical instruments have been proposed in order to carry out various arithmetic operations and they in general include very complicated arithmetic circuits made up of a number of multipliers and/or adders. Inclusion of such intricate arithmetic circuit naturally causes enlargement in construction and, consequently, increase in production cost.

SUMMARY OF THE INVENTION

It is the object of the present invention to provide an electronic musical instrument which is capable of generating musical tones with a greatly simplified circuit construction.

In accordance with the basic aspect of the present invention, at least two pulse signals are initially formed having a prescribed phase difference upon key operation, each having a frequency corresponding to the tonal pitch of the operated key. On the basis of these pulse signals, sampling is applied, at a frequency corresponding to the tonal pitch of the operated key, to an envelope waveshape to be generated in accordance with the operated key. Polarities of the sample values of the generated envelope waveshape are properly converted in order to form a musical tone waveshape from the generated envelope waveshape. The musical tone waveshape so formed is then passed, for generation of a corresponding musical tone, to a sound system including elements such as amplifiers and speakers.

BRIEF DESCRIPTION OF DRAWINGS

FIGS. 4, 4A and 4B are a block diagram for the first embodiment of the electronic musical instrument in accordance with the present invention, wherein FIGS. 4A and 4B illustrate, in schematic form, first and second halves of the block diagram of the embodiment of the invention and FIG. 4 shows the manner in which these figures are connected;

FIG. 9 is a block diagram for the adder used for a modification of the first embodiment shown in FIG. 4, FIGS. 10, 10A and 10B are a block diagram for the second embodiment of the electronic musical instrument in accordance with the present invention, wherein FIG. 11 is a timing chart for operation of the second embodiment shown in FIG. 10, FIGS. 12, 12A and 12B are a block diagram for the third embodiment of the electronic musical instrument in accordance with the present invention, wherein

DESCRIPTION OF THE PREFERRED EMBODIMENTS

Figure 1:
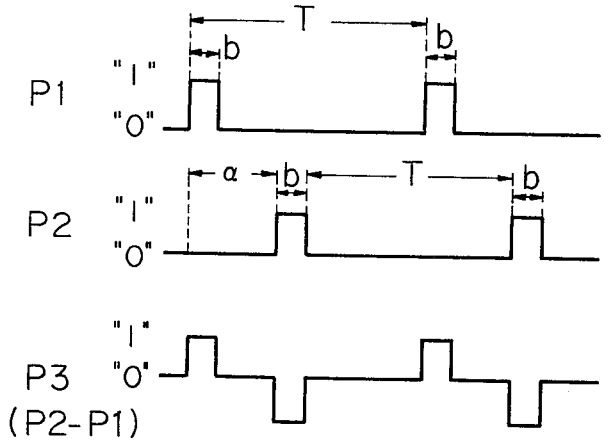
FIG. 1 is a graphical representation of one examples of the basic pulse signals P1, P2 and P3 used in the present invention.

The basic principle upon which the present invention is based will hereinafter be described in reference to FIG. 1, in which two pulse signals P1 and P2 are formed with a prescribed phase difference between them. The pulse signals P1 and P2 both have same frequencies corresponding to the tonal pitch of the operated key, i.e. the note to be played. By subtraction of the pulse signal P2 from the pulse signal P1, a pulse signal P3 as shown in FIG. 1 is formed. This pulse signal P3 is subjected to multiplication by a prescribed envelope in order to have a corresponding envelope and be generated as a corresponding musical tone.

The pulse signal P3 in FIG. 1 is subjected to Fourier analysis so as to obtain the following equation (I);

$$P3(t) = \frac{4}{\pi} \Sigma \frac{1}{n} \cdot \sin 2n\pi \frac{b}{T} \cdot \sin 2n\pi \frac{\alpha}{T} \cdot \sin 2n\pi \frac{t}{T} \qquad \text{(I)}$$

T: Period of the pulse signals P1 and P2.

b: Pulse width of the pulse signals P1 and P2.

$\alpha$: Phase difference between the pulse signals P1 and P2.

Figure 2:
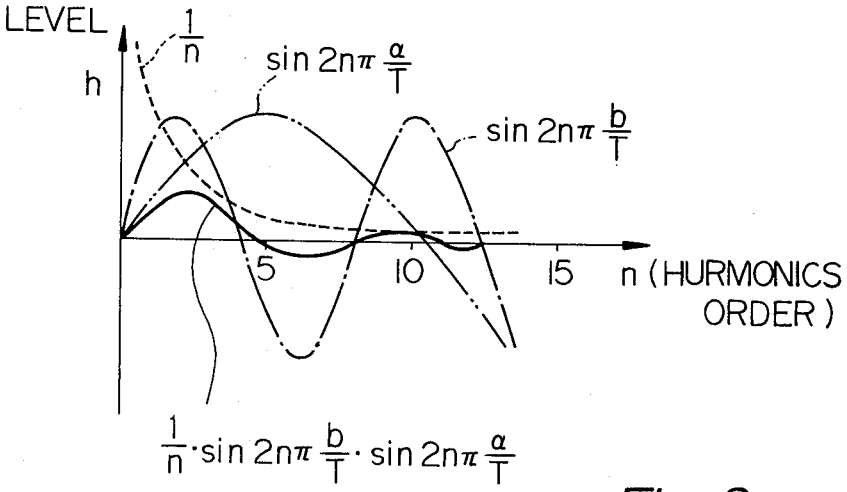
FIG. 2 is a graphical representation of the spectrum envelope waveshapes for the pulse signal P3 shown in FIG. 1.

The coefficient term of the equation (I) is;

$$\frac{1}{n} \cdot \sin 2n\pi \frac{b}{T} \cdot \sin 2n\pi \frac{\alpha}{T} \; (= h) \qquad \text{(II)}$$

and this coefficient term is shown, in the form of spectrum envelope, in FIG. 2 in which the level of the coefficient "h" is taken on the ordinate whilst the harmonics order number "n" is taken on the abscissa. As is clear from the illustration, the level "h" oscillates as the order number "n" varies. That is, the pulse signal P3 shown in FIG. 1 has resonance characteristics and, consequently, the musical tone waveshape made from the pulse signal P3 also has resonance characteristics. Due to the resonance characteristics by the pulse signal P3, the musical tone generating system of this sort is suited for composition of resonant musical tones to be generated by wind instruments.

Figure 3:
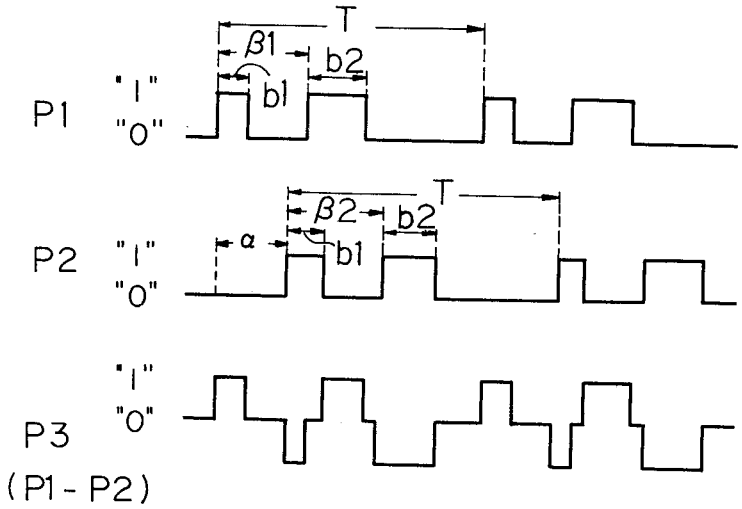
FIG. 3 is a graphical representation of another examples of the basic pulse signals P1, P2 and P3 used in the present invention.

Another examples of the pulse signals P1, P2 and P3 are shown in FIG. 3 in which the pulse signals P1 and P2 each has two (or more may be employed) different square waves per period and the pulse P3 is obtained by subtracting the pulse signal P2 from the pulse signal P1.

When the resultant pulse signal P3 is used for generation of a corresponding musical tone, musical tones of a wide variety of tone colors can be obtained by varying the pulse interval "$\beta 1$" of the pulse signal P1, the pulse interval "$\beta 2$" of the pulse signal P2 and the phase difference "$\alpha$" between the pulse signals P1 and P2.

It is also employable to construct an electronic musical instrument by combination of two or more units, each being generative of the above-described sorts of musical tone waveshapes, i.e. the pulse signals P3. That is, by means of tactfully designed modulation of phase difference and/or frequency difference for musical tone waveshapes generated by the two or more units of the above-described sort, it is also possible to provide generated musical tones with the socalled chorus effect.

One embodiment of the electronic musical instrument in accordance with the present invention is shown in FIG. 4. The output side of a keyboard circuit 1 having a number of output lines is coupled to the input side of an accumulator 3 via a frequency information memory 2. A pair of pulse signal generating circuits 4 and 5 are coupled to the output side of the accumulator 3 whose accumulation command terminal A is receptive of a clock pulse signal $\phi$. The output side of one pulse signal generating circuit 4 is coupled to the conversion command terminal B of an amplitude converter 9 and, via an exclusive-OR-circuit 7, to the gating command terminal G of a gate circuit 8, respectively.

An envelope waveshape generator 6 is coupled to the keyboard circuit 1 in order to receive a key-on signal KON of "logic 1" when any of the keys is operated. The gate circuit 8 is interposed between the envelope waveshape generator 6 and the amplitude converter 9. The amplitude converter 9 is further coupled to a sound system 11 via a digital-analog converter 10. The other pulse signal generator 5 is also coupled to the gating command terminal G of the gate circuit 8 via the exclusive-OR-circuit 7.

When a key is operated on the keyboard (not shown), an output "logic 1" appears on an output line of the keyboard circuit 1 which corresponds to the operated key. The keyboard circuit 1 which corresponds to the operated key. The keyboard circuit 1 includes, as an example for simplicity of explanation, a single note preference circuit (not shown), which has a function to single out a note to be generated when two or more keys are concurrently operated on the keyboard. The frequency information memory 2 is provided with a number of addresses each of which stores a frequency information F (value) proportional to the tonal pitch of a corresponding key. That is, an address corresponding to a key of higher tonal pitch stores a larger frequency information F whereas an address corresponding to a key of lower tonal pitch stores a smaller frequency information F.

The accumulator 3 repeatedly accumulates the frequency informations F upon every receipt of the clock pulse signal $\phi$ and generates their accumulated values qF (q=1, 2, 3 . . . ). As an accumulated value qF exceeds the full count number, the accumulator 3 overflows and repeats same accumulation from the starting.

Figure 7:
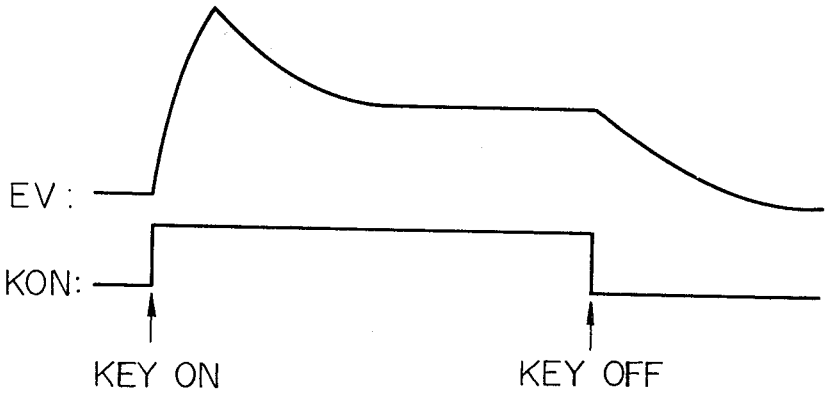
FIG. 7 is a graph for showing one example of the envelope waveshape.

Upon receipt of a key-on signal KON showing operation of a key, the envelope waveshape generator 6 generates an envelope waveshape EV such as shown in FIG. 7, which is given in the form of a digital signal.

The one pulse signal generating circuit 4 includes logic elements such as AND-gates and invertors. Upon receipt of an accumulated value qF from the accumulator 3, the pulse signal generating circuit 4 generates a pulse signal P1 whose frequency corresponds to the tonal pitch of the operated key.

The other pulse signal generating circuit 5 likewise includes logic elements such as AND-gates and invertors. Upon receipt of an accumulated value qF from the accumulator 3, the pulse signal generating circuit 5 generates a pulse signal P2. This pulse signal P2 is common in frequency to but different in phase from the pulse signal P1.

When an input "logic 1" is passed to the conversion command terminal B of the amplitude converter 9, the same converts an envelope waveshape EV taken from the generator 6 from positive to negative and generates the converted value. When an input "logic 0" is received at the terminal B, the amplitude convertor 9 allows free passage of an envelope waveshape EV from the generator 6 without any conversion.

A complement circuit can be mentioned as a typical example of the above-described amplitude convertor 9. By seeking a complement for the given envelope waveshape EV, a digital value, the amplitude of the envelope waveshape EV can be converted from positive to negative. For example, when the envelope waveshape EV is to be expressed in 1's complement notation, the entire bits of the envelope waveshape are subjected to inversion for conversion of from positive to negative.

Operation of the above-described first embodiment of the present invention is as follows.

When a certain key is operated on the keyboard, an output "logic 1" appears on an output line of the keyboard circuit 1, which corresponds to the operated key. Upon receipt of this output "logic 1", the frequency information memory 2 generates a frequency information F corresponding to the operated key. Same frequency informations F is applied to the accumulator 3 for accumulation at every input of the clock pulse signal $\phi$. The period in which the accumulated value qF (q=1, 2, 3 . . . ) reaches the full count value (modulo) is, as already described, proportional to the tonal pitch of the operated key, since the frequency information F has a value corresponding to the operated key. When a key of a very high tonal pitch is operated, the accumulated value qF clears the full count value within a very short period. Whereas, the accumulated value qF requires a long period to clear the full count value when a key of a low tonal pitch is operated.

The accumulated value qF from the accumulator 3 is applied to the one pulse signal generating circuit 4 for formation of the one pulse signal P1. Likewise, the other pulse signal generating circuit 5 produces the other pulse signal P upon receipt of the accumulated value qF. These pulse signals P1 and P2 are graphically represented in FIG. 1.

Figure 5A:
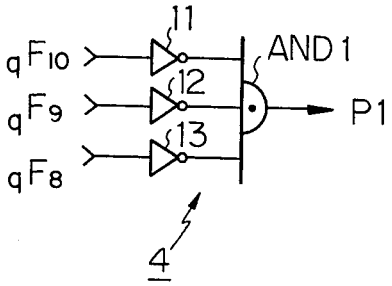
FIGS. 5A and 5B are circuit diagrams for the pulse signal generating circuits used in the first embodiment shown in FIG. 4.
Figure 5B:
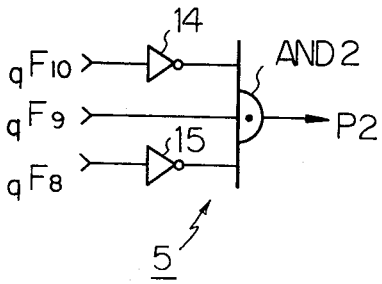

Examples of the pulse signal generating circuits 4 and 5 are shown in FIGS. 5A and 5B, respectively. In these cases, it is assumed that the accumulator 3 generates accumulated values qF each having 10 bits of signals ($qF_1$, $qF_2$, . . . $qF_9$, $qF_{10}$). Among these 10 bits, the highest 3 bits signals $qF_{10}$, $qF_9$ and $qF_8$ are passed to the pulse signal generating circuits 4 and 5.

As is clear from FIG. 5A, the signals $qF_{10}$, $qF_9$ and $qF_8$ passed to the pulse signal generating circuit 4 are inverted by invertors I1, I2 and I3 and further passed to an AND-circuit AND1. When the signals $qF_{10}$, $qF_9$ and $qF_8$ all assume "logic 0", an AND condition is satisfied at the AND-circuit AND1 which thereupon generates the pulse signal P1.

It is also clear from FIG. 5B that the signals $qF_{10}$ and $qF_8$ are inverted by invertors I4 and I5 so as to be passed to an AND-circuit AND2, respectively. Whereas, the signal $qF_9$ is directly applied to the AND-circuit AND2. When the signals $qF_{10}$ and $qF_8$ assume "logic 0" and the signal $qF_9$ assumes "logic 1", an AND condition is satisfied at the AND-circuit AND2 which thereupon generates the pulse signal P2.

Figure 6:
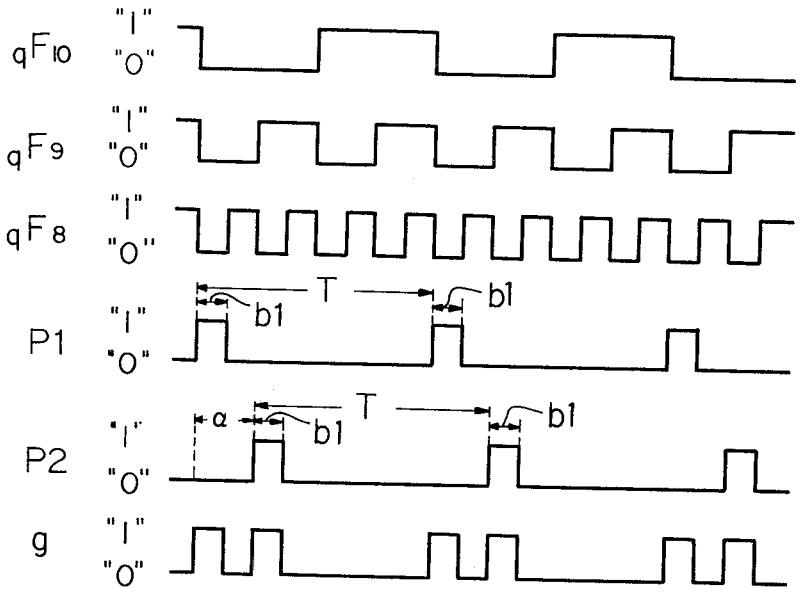
FIG. 6 is a timing chart for operation of the first embodiment shown in FIG. 4.

Here, it should be recalled that the length of the time needed for full counting at the accumulator 3 is inversely proportional to the tonel pitch of the operated key. Thus, the periods T, T/2 and T/4 for the signals $qF_{10}$, $qF_9$ and $qF_8$ in FIG. 6 are inversely proportional to the tonal pitch of the operated key, respectively. The periods T, T/2 and T/4 are short when a key of a high tonal pitch is operated and they are long when a key of a low tonal pitch is operated. Consequently, the period T for the pulse signals P1 and P2 is inversely proportional to the tonal pitch of the operated key.

The pulse signals P1 and P2 from the pulse signal generating circuits 4 and 5 are then applied to the exclusive-OR-circuit 7. As shown in FIG. 6, the exclusive-OR-circuit 7 generates "logic 1" only when either of the pulse signals P1 and P2 assumes "logic 1". The output q from the exclusive-OR-circuit 7 is then passed, as a gating command signal, to the gating command terminal G of the gate circuit 8. The gate circuit 8 opens when the gating command signal g assumes "logic 1".

Figure 8A:
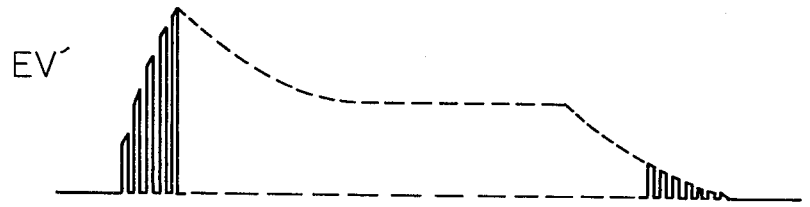
FIG. 8A is a graph for showing one example of the envelope waveshape taken from the gate circuit shown in FIG. 4.

Upon key operation, the keyboard circuit 1 applies a key-on signal KON to the envelope waveshape generator 6 which thereupon generates an envelope waveshape EV shown in FIG. 7, a digital signal. The envelope waveshape EV is passed to the amplitude converter 9 via the gate circuit 8 when the gate circuit 8 is open. In other words, the envelope waveshape EV is allowed to reach the amplitude converter 9 only when either of the pulse signals P1 and P2 assumes "logic 1". FIG. 8A shows an envelope waveshape EV' generated by the gate circuit 8.

The amplitude converter 9 inverts polarity of amplitude of the envelope waveshape EV' only when the pulse signal P1 assumes "logic 1". That is, every time the pulse signal P1 assumes "logic 1", the amplitude converter 9 converts amplitude of the envelope waveshape EV' from positive to negative. Thus, the amplitude converter 9 generates a musical tone waveshape MW shown in FIG. 8B.

Figure 8B:
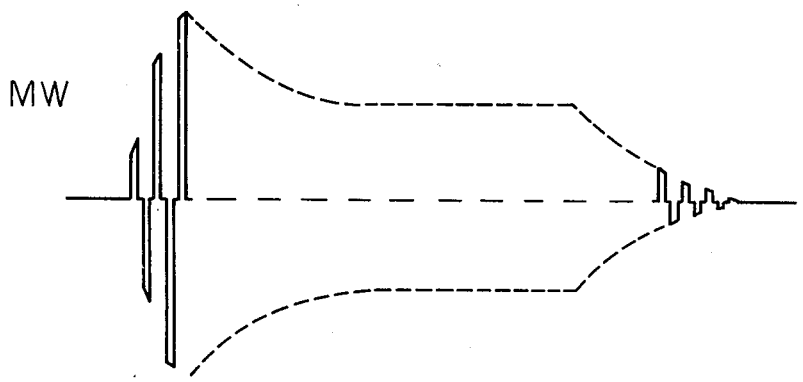
FIG. 8B is a graph for showing one example of the musical tone waveshape generated by the first embodiment.

Here, it should be noted that the period T for the pulse signals P1 and P2 corresponds to the basic period for the musical tone to be generated and actually is very much shorter than the full wave length of the envelope wageshape EV shown in FIG. 7. In other words, the envelope waveshape EV and the musical tone waveshape MW in FIGS. 8A and 8B are both given in shemata. Their actual frequencies are by far higher than those given in the illustrations.

In the way described, the envelope waveshape EV is converted into the musical tone waveshape MW by the gate circuit 8 and the amplitude converter 9 and the musical tone waveshape MW is passed to the sound system 11 for generation of a corresponding musical tone after the digital-analog conversion at the D/A converter 10.

Figure 9:
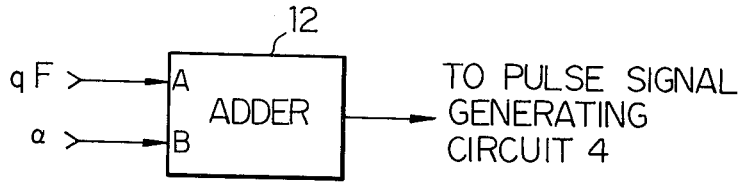

In the foregoing description, the arrangements shown in FIGS. 5A and 5B are mentioned as examples of the pulse signal generating circuits 4 and 5. It is also employable in the present invention, however, to provide the two pulse signal generating circuits 4 and 5 with a same construction and to interpose an adder 12 such as shown in FIG. 9 between the pulse signal generator 4 and the accumulator 3. In this case, a parameter $\alpha$ at the input terminal B of the adder 12 and the accumulated value qF from the accumulator 3 are added to each other at the adder 12 and the added value ($\alpha$+qF) is applied to the pulse signal generating circuit 4. In contrast to this, the pulse signal generating circuit 5 receives the accumulated value qF taken directly from the accumulator 3. Consequently, the phase of the pulse signal P1 from the circuit 4 is ahead by $\alpha$ of that of the pulse signal P2 from the circuit 5 as shown in FIG. 1. When the parameter $\alpha$ is time variable, the pulse signals P1 and P2 can be varied with time, whereby the tone color of a musical tone can be varied from the start to finish of the tone generation.

In accordance with the first embodiment of the present invention, the electronic musical instrument can be constructed with considerably reduced cost without asking for use of a complicated arithemetic circuit including a number of adders and multipliers.

Figures 10, 10A:
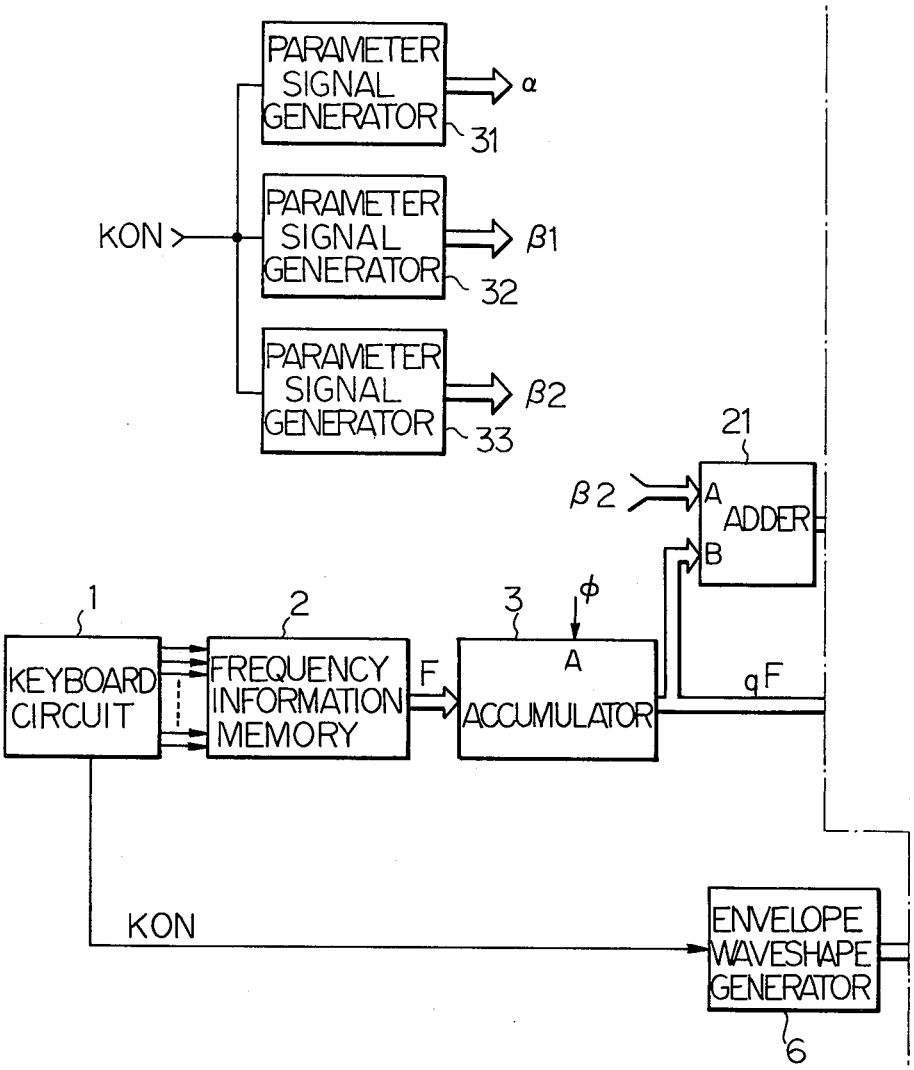
FIGS. 10A and 10B illustrate, in schematic form, first and second halves of the block diagram of the embodiment of the invention
FIG. 10 shows the manner in which these figures are connected.
Figure 10B:
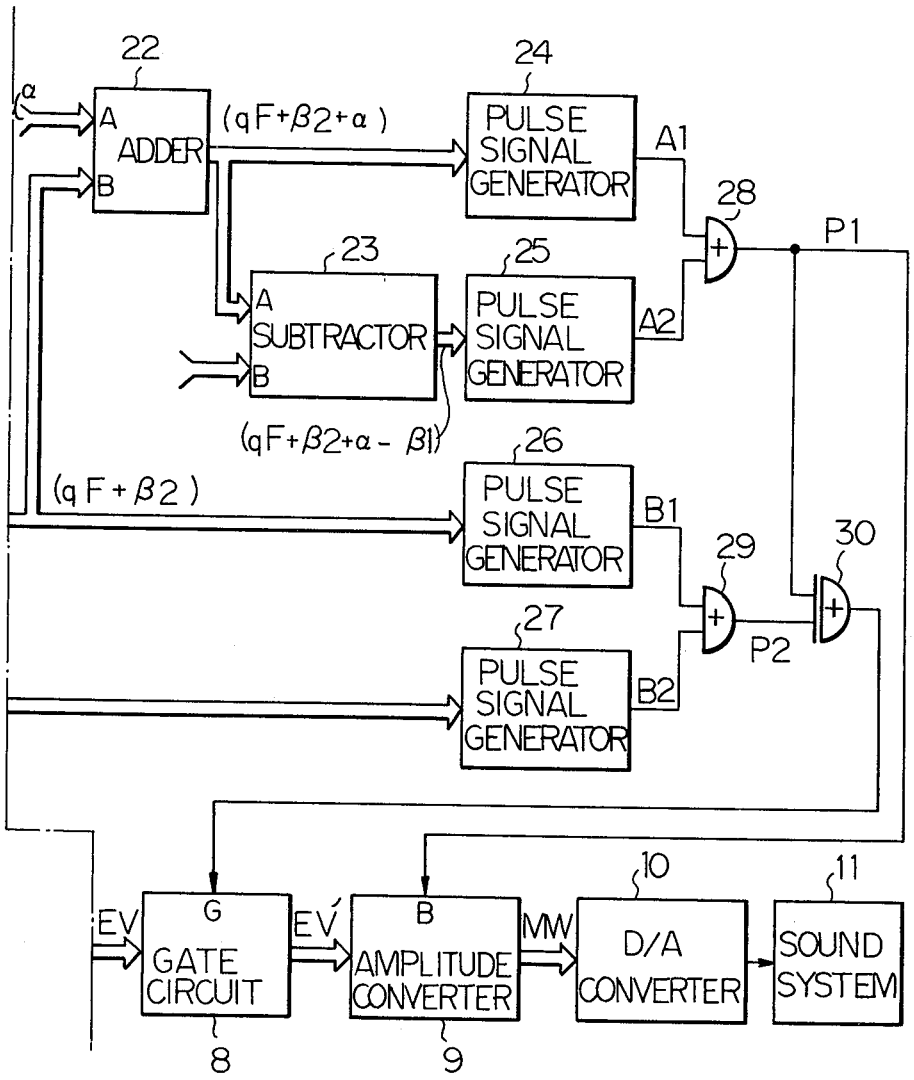

The second embodiment of the present invention is shown in FIG. 10, in which elements and signals substantially same in construction and function with those used in the first embodiment in FIG. 4 are designated by same reference numerals.

In accordance with the basic principle of this embodiment. Musical tone waveshapes MW are generated out of corresponding envelope waveshapes EV on the basis of pulse signals P1 and P2 each of which has a frequency corresponding to tonal pitch of the operated key and includes two square waves.

In FIG. 10, the output side of the accumulator 3 is coupled, on the one hand, to a pulse signal generating circuit 27 and, on the other hand, to one input terminal of an adder 21. The other input terminal A of the adder 21 is coupled to a parameter signal generator 33 in order to receive a parameter signal $\beta 2$ therefrom.

The output side of the adder 21 is coupled, on the one hand, to a pulse signal generator 26 and, on the other hand, to one output terminal B of an adder 22. The other input terminal A of the adder 22 receives a parameter signal $\alpha$ taken from a parameter signal generator 31.

The output side of the adder 22 is coupled, on the one hand, to a pulse signal generating circuit 24 and, on the other hand, to a subtractor 23 whose one input terminal B receives a parameter signal $\beta 1$ from the parameter signal generator 32. The output sides of the pulse signal generators 24 and 25 are both coupled to an OR-circuit 28 whereas those of the pulse signal generators 26 and 27 are both coupled to an OR-circuit 29.

The output side of the one OR-circuit 28 is coupled, on the one side, to an exclusive-OR-circuit 30 and, on the other side, to the conversion command terminal B of the amplitude converter 9. Whereas, the output side of the other OR-circuit 29 is coupled, on the one side, to the exclusive-OR-circuit 30 and, on the other side, to the gating command terminal G of the gate circuit 8.

Figure 11:
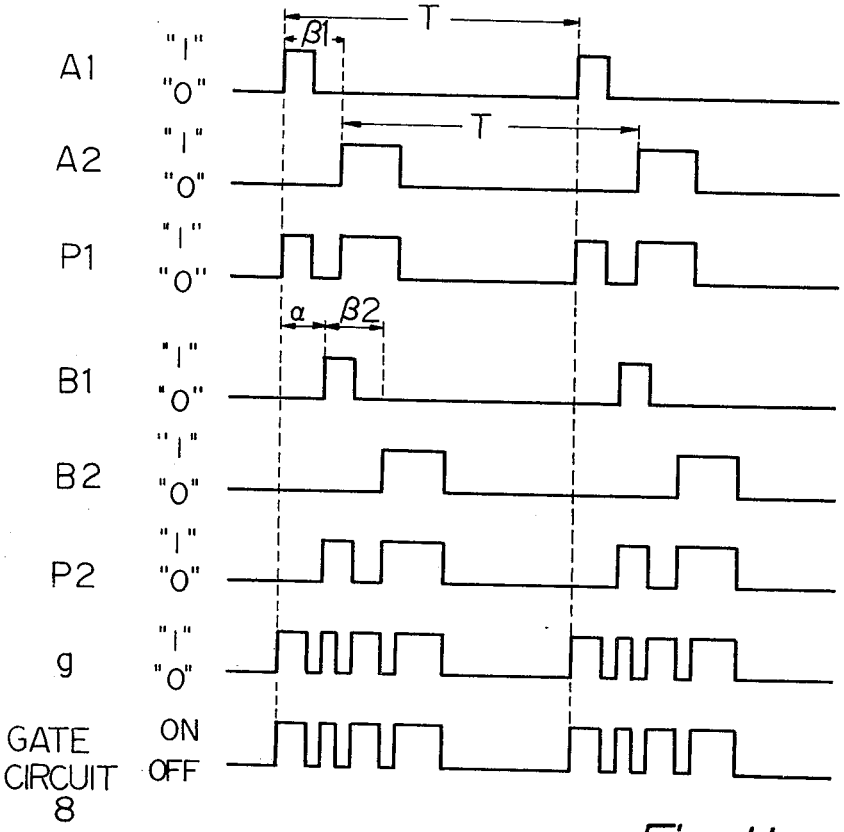

The parameter signal generators 31 to 33 are constructed so that they generate parameter signals $\alpha$, $\beta 1$ and $\beta 2$ when the key-on signal KON is taken from the keyboard circuit 1, which designates operation of any key. In the subtractor 23, a digital datum passed to its input terminal B is subtracted from a corresponding digital datum passed to its input terminal A and the result is generated and applied to the pulse signal generator 25. Like the pulse signal generated circuits 4 and 5 shown in FIG. 4, the pulse signal generators 24 to 27 in this embodiment are made of logic elements such as AND-circuits and invertors and, upon receipt of digital signals, generate pulse signals A1, A2, B1 and B2 as shown in FIG. 11.

Operation of the second embodiment of the present invention with the above-described construction will hereinafter be described in sequence.

Like the first embodiment, any of the keys is operated on the keyboard and corresponding frequency information F is read out from the frequency information memory 2 by means of an addressing signal given by the keyboard circuit 1. Every time the clock pulse signal $\phi$ is applied to the accumulator 3, the latter accumulates the frequency information F in order to generate accumulated values qF ($q=1, 2, 3 \ldots$) when the full count (modulo) is reached. Concurrently with this procedure, a key-on signal KON is generated by the keyboard circuit 1 so that the parameter signal generators 31 to 33 generates the parameter signals $\beta 1$ and $\beta 2$, respectively, and the envelope waveshape generator 6 generates an envelope waveshape EV.

Each accumulated value qF from the accumulator 3 is passed, on the one hand, to the pulse signal generator 27 and, on the other hand, to the adder 21 whereat a parameter signal $\beta 2$ from the parameter signal generator 33 is added to the accumulated value qF so that a signal ($qF+\beta 1$) is passed to the pulse signal generator 26. As is clear from FIG. 11, the pulse signal B1 from the pulse signal generator 26 is ahead in phase of the pulse signal B2 from the pulse signal generator 27 by a value corresponding to the parameter signal $\beta 2$.

The output ($qF+\beta 2$) from the adder 21 is passed to the adder 22 whereat the parameter signal $\alpha$ from the parameter signal generator 31 is added to this value so that a resultant signal ($qF+\beta 2+\alpha$) should be passed to the pulse signal generator 24. Consequently, the pulse signal A1 from the pulse signal generator 24 is ahead in phase of the pulse signal B1 from the pulse signal generator 26 by a value corresponding to the parameter signal $\alpha$.

The signal ($qF+\beta 2+\alpha$) is passed to the subtractor 23 whereat the parameter signal $\beta 1$ is subtracted from this value and the resultant signal ($qF+\beta 2+\alpha-\beta 1$) is then applied to the pulse signal generator 25. Consequently, it is clear from FIG. 11 that the pulse signal A1 from the pulse signal generator 24 is ahead in phase of the pulse signal A2 from the pulse signal generating circuit 25 by a value corresponding to the parameter signal $\beta 1$.

It should be here noted that the periods T for the pulse signals A1, A2, B1, and B2 from the generators 24 to 27 are inversely to the tonal pitch or the corresponding operated key.

The pulse signals A1 and A2 so generated are then applied to the OR-circuit 28 which thereupon generates a pulse signal P1 shown in FIG. 11. Similarly, the pulse signals B1 and B2 are passed to the OR-circuit 29 for generation of a pulse signal P2 shown in FIG. 11. Since the pulse signals A1, A2, B1 and B2 have a period T corresponding to the operated key, the periods of the signals P1 and P2 are also equal to T.

The pulse signals P1 and P2 are both passed to the exclusive-OR-circuit 30 which generates an output "logic 1" only when either of the pulse signals P1 and P2 assumes "logic 1". This pulse train g is illustrated in FIG. 11 and the pulse signal from the OR-circuit 30 is then passed to the gating command terminal G of the gate circuit 8 for control of its gating operation. When the gate circuit 8 is thus made open, the gate circuit 8 allows passage of the envelope waveshape EV after conversion into the form of the envelope waveshape EV' shown in FIG. 8A.

The pulse signal P1 from the OR-circuit 28 is passed directly to the conversion command terminal B of the amplitude converter 9 so that the amplitudes of each envelope waveshape EV' from the gating circuit 8 are converted from positive to negative and, consequently, the converter 9 generates a corresponding musical tone waveshape MW such as shown in FIG. 8B. In connection with this, it should be noted that the pulse signals P1 and P2 both have periods T which corresponds to the tonal pitch of the corresponding operated key, that each musical tone waveshape is formed from combination of such pulse signals P1 and P2, and that, consequently, the period for the musical tone waveshape MW is inversely proportional to the tonal pitch of the corresponding operated key. Consequently, the musical tone waveshape MW so generated is proportional to the tonal pitch of the corresponding operated key. The musical tone waveshape MW is then converted into a corresponding analog signal by the digital-analog converter 10 in order to generate a corresponding musical tone via passage through the sound system 11.

It is also employable to make the parameter signals $\alpha$, $\beta 1$ and $\beta 2$ from the generators 31 to 33 be time variable, whereby the tone color of the generated musical tone can timewisely vary from start to finish. In this case, for example, a suitable waveshape is stored at a read-only memory, and reading-out is performed by applying a series of prescribed clock pulse signal to the memory in order to generate a parameter signal which varies with time.

As is clear from the foregoing description, the second embodiment of the present inventional enables provision of cheap electronic musical instruments with considerable reduction in number of arithmetic circuit elements such as multipliers and adders.

Figures 12, 12A:
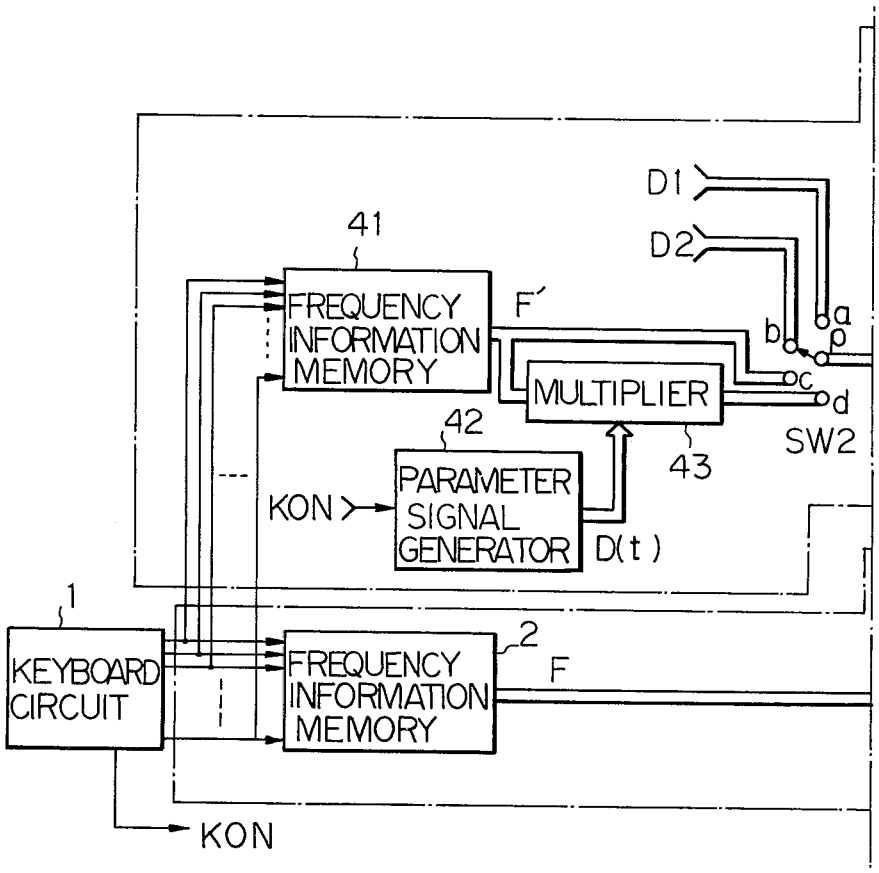
FIGS. 12A and 12B illustrate, in schematic form, first and second halves of the block diagram of the embodiment of the invention
FIG. 12 shows the manner in which these figures are connected.
Figure 12B:
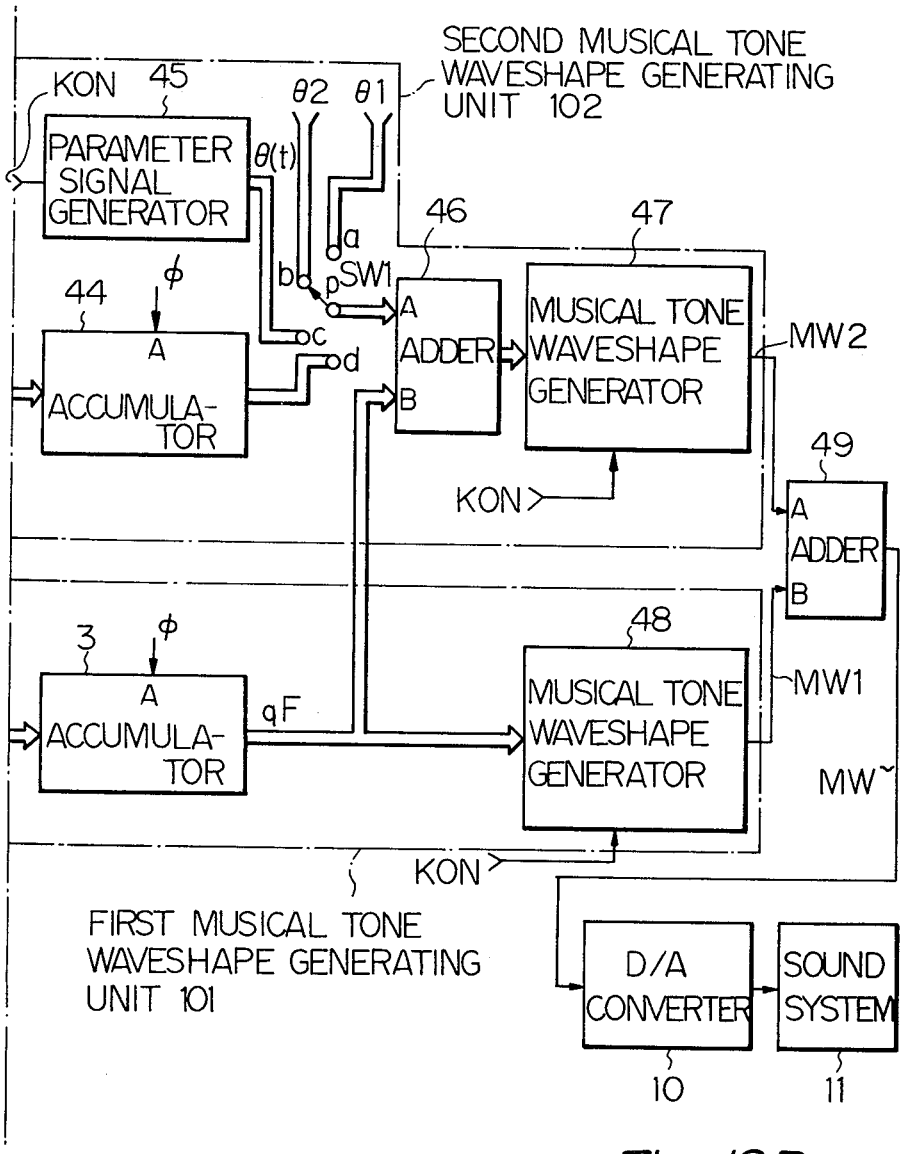

The third embodiment of the present invention is shown in FIG. 12, in which elements and signals substantially similar in construction and operation to those used in the preceding embodiments are designated by similar reference numerals and symbols.

In brief, the electronic musical instrument of this embodiment includes the first and second musical tone waveshape generating units 101 and 102 generative of two musical tone waveshapes MW1 and MW2, which are different in phase and/or frequency. After generation, the two musical tone waveshapes MW1 and MW2 are added to each other in order to generate a new musical tone waveshape MW which should be applied to the sound system 11 for generation of a corresponding musical tone. Through addition of the two musical tone waveshapes MW1 and MW2 different in phase and/or frequency, the third embodiment of the present invention is able to provide a resultant musical tone with beautiful chorus effect.

Here the term "chorus effect" refers to a musical accoustic effect in which, take two violins to be played together for example, a slight difference in tonal pitch between the musical tones generated by the different violins affords rich tonal impression. The tonal pitch of a musical tone generated by a violin is dependant upon the frequency of the string generating the musical tone and the tension on the string is adjusted so as to generate a musical tone having a prescribed tonal pitch. It is almost impossible in practice to adjust two violins over all strings so that frequencies on corresponding two strings on different violins should be fully identical to each other. This inconsistency in frequency results in the above-described chorus effect.

As shown in FIG. 12, the first musical tone waveshape generating unit 101 includes a frequency information memory 2, an accumulator 3 and a musical tone waveshape generator 48. Upon receipt of accumulated values qF taken from the accumulator 3, the musical tone waveshape generator 48 generates a plurality of pulse signals each of which has a period T corresponding to the tonal pitch of the operated key. Sampling is applied to the envelope EV on the basis of these pulse signals whereby the envelope waveshape EV is generated upon receipt of a key-on signal KON from the key-board circuit 1. The amplitude of the sampled envelope waveshape EV′ is properly reversed in polarity in order to generate a corresponding musical tone waveshape MW1. This musical tone waveshape generator 48 corresponds to a combination of, in the first embodiment shown in FIG. 4, the pulse signal generating circuits 4 and 5, the exclusive-OR-circuit 7, the envelope waveshape generator 6, the gate circuit 8 and the amplitude converter 9. The generator 48 further corresponds to a combination of, in the second embodiment shown in FIG. 10, the adders 21 and 22, the subtractor 23, the pulse signal generators 24 to 27, the OR-circuits 28 and 29, the exclusive-OR-circuit 30, the envelope waveshape generator 6, the gate circuit 8 and the amplitude converter 9. Consequently, except for provision of the second musical tone waveshape generating unit 102 and an adder 49, the instrument of this embodiment is quite similar to those of the first and second embodiments.

It should be noted that a musical tone waveshape generator 47 used for the second unit 102 is quite same in construction with this generator 48.

As shown in FIG. 12, the second musical tone waveshape generating unit 102 includes a frequency information memory 41 to which the output lines of the keyboard circuit 1 is coupled. The output side of the frequency information memory 41 is coupled, on the one hand, to the first input terminal of a multiplier 43 and, on the other hand, to the fixed contact c of a switch SW2.

The frequency information memory 41 stores in its addresses a number of different frequency informations F′ (value) each corresponding to the tonal pitch of an associated key. Each frequency information F′ stored in the memory 41 is smaller in size than each corresponding frequency information F stored in the memory 2 of the first musical tone waveshape generating unit 101.

The second input terminal of the multiplier 43 is coupled to a parameter signal generator 42 which generates a time-functional parameter signal D(t) upon receipt of every key-on signal KON. The output side of the multiplier 43 is coupled to a fixed contact d of the switch SW2 whose fixed contacts a and b are receptive of time-independent parameter signals D1 and D2.

The movable contact p of the switch SW2 is coupled to the input side of an accumulator 44 whose accumulation command terminal A is receptive of a series of clock pulse signal $\phi$. The output side of this accumulator 44 is coupled to a fixed contact d of a switch SW1 whose fixed contact c is in turn coupled to the output side of a parameter signal generator 45. The parameter signal generator 45 generates a time-functional parameter signal D(t) upon receipt of every key-on signal KON. Fixed contacts a and b of the switch SW1 are receptive of time-independent parameter signals $\theta 1$ and $\theta 2$.

The movable contact p of the switch SW1 is coupled to the one input terminal A of an adder 46 whose other input terminal B is coupled to the accumulator 3 of the first unit 101. The output side of the adder 46 is coupled to a musical tone waveshape generator 47 which is fully similar in construction to the musical tone waveshape generator 48 used in the first unit 101 and adapted for generation of a musical tone waveshape MW2.

The output side of the musical tone waveshape generator 47 of the second unit 102 is coupled to the one input terminal A of an adder 49 whose other input terminal B is coupled to the output side of the musical tone waveshape generator 48 of the first unit 101. The output side of the adder 49 is coupled to the sound system 11 via the digital-analog converter 10.

Operation of the above-described third embodiment of the present invention will hereinafter be explained in more detail.

Operation of the first musical tone waveshape generating unit 101.

When a certain key is operated on the keyboard, a signal "logic 1" appears on a corresponding output line from the keyboard circuit 1 which is then passed to the frequency information memory 2 of the first unit 101 for generation of a corresponding frequency information F. Frequency information F from the memory 2 is subsequently passed to the accumulator 3 whereat they are accumulated upon reception of the clock pulse signals $\phi$. Each accumulated value qF (q=1, 2, 3 . . .) is then passed, on the one hand, to the musical tone waveshape generator 48 and, on the other hand, to the input terminal B of the adder 46 of the second musical tone waveshape generating unit 102. The musical tone waveshape generator 48 receives the accumulated value qF and a key-on signal KON from the keyboard circuit 1 in order to generate a corresponding musical tone waveshape MW1 in a manner same with those in the first and second embodiments of the invention. This first musical tone waveshape MW1 is applied to the input terminal B of the adder 49.

Operation of the second musical tone waveshape generating unit 102

The second musical tone waveshape generating unit 102 operates under the following three different conditions;

(i) The movable contact p of the switch SW1 is put into contact with either of the fixed contacts a and b.

(ii) The movable contact p of the switch SW1 is put into contact with the fixed contact c.

(iii) The movable contact p of the switch SW1 is put into contact with the fixed contact d.

The third condition (iii) can further be classified into the following three different subordinate conditions;

(iii)' The movable contact p of the switch SW2 is put into contact with either of the fixed contacts a and b.

(iii)'' The movable contact p of the switch SW2 is put into contact with the fixed contact c.

(iii)''' The movable contact p of the switch SW2 is put into contact with the fixed contact d.

The operation of the second musical tone waveshape generating unit 102 under the above-described different conditions will hereinafter be explained in more detail in the described order.

(i) Under the first condition in which the movable contact p of the switch SW1 is put into contact with either of the fixed contacts a and b.

Under this condition, either of the time-independent parameter signals $\theta 1$ and $\theta 2$ is applied to the input terminal A of the adder 46 which thereupon generates either of the added values ($qF+\theta 1$) and ($qF+\theta 2$). The musical tone waveshape generator 47 receives the key-on signal KON from the keyboard circuit 1 and either of the added values ($qF+\theta 1$) and ($qF+\theta 2$) in order to generate a second musical tone waveshape MW2 which is ahead in phase of the first musical tone waveshape MW1 from the first musical tone waveshape generating unit 101 by a value corresponding to either of the parameter signals $\theta 1$ and $\theta 2$. As described already, the musical tone waveshape generators 47 and 48 are quite common in construction to each other. Consequently, they generate musical tone waveshapes MW1 and MW2 which are different in phase from each other by the difference between the input digital signals.

The musical tone waveshapes MW1 and MW2 so generated are added to each other at the adder 49, converted into a corresponding analog signal at the digital-analog convertor 10, and generated as a corresponding musical tone by the sound system 11.

(ii) Under the second condition in which the movable contact p of the switch SW1 is put into contact with the fixed contact c.

Under this condition, the parameter signal generator 45 generates, upon receipt of a key-on signal KON taken from the keyboard circuit 1, a time-functional parameter signal $\theta(t)$ which is in turn applied to the one input terminal A of the adder 46. The other input terminal B of the adder 46 receives an accumulated value qF from the accumulator 3 of the first musical tone waveshape generating unit 101. Consequently, the adder 46 generates an added value $\{qF+\theta(t)\}$. Thus, the second musical tone waveshape MW2 generated by the generator 47 is ahead in phase of the first musical tone waveshape MW1 generated by the generator 48 by a value corresponding to the parameter signal $\theta(t)$. Since the parameter signal $\theta(t)$ is time-functional, the difference in phase between the musical tone waveshapes MW2 and MW1 varies with time. The musical tone waveshapes MW1 and MW2 are passed to the input terminals A and B of the adder 49, respectively, in order to generate a new corresponding musical tone waveshape MW after addition. This musical tone waveshape MW is then passed to the digital-analog converter 10 and the sound system 11 for generation of a corresponding musical tone. Since the difference in phase between the two musical tone waveshapes MW1 and MW2 varies with time, the musical tone has a richer tone quality under this second condition than that obtained under the first condition.

(iii)' Under the third condition in which the movable contact p of the switch SW1 is put into contact with the fixed contact d whereas the movable contact p of the switch SW2 is put into contact with either of the fixed contacts a and b.

Under this condition, either of the time-independent parameter signals D1 and D2 is applied to the input side of the accumulator 44 which accumulates the input signals upon receipt of the clock pulse signal $\phi$. Each accumulated value qD1 or qD2 is then passed to the one input terminal A of the adder 46 via the switch SW1.

The other input terminal B of the adder 46 receives the accumulated values qF ($q=1, 2, 3 \ldots$) from the accumulator 3 of the first musical tone waveshape generating unit 101. Then, the adder 46 generates either of the added values ($qD1+qE$) and ($qD2+qF$). In connection with this, however, the accumulator 3, the accumulator 44 and the adder 46 are common in full count value (modulo) to each other. Therefore, either of the output value ($qD1+qF$) and ($qD2+qF$) does never exceed this full count value.

Figure 13A:
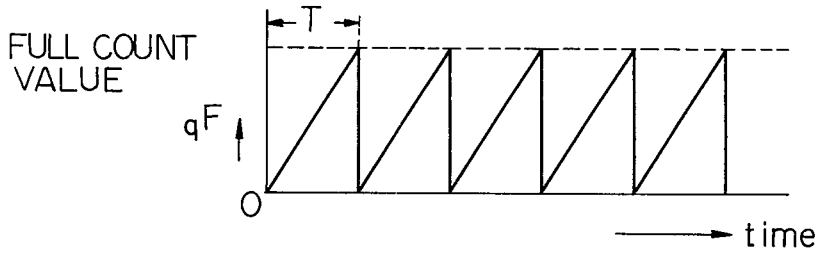
FIG. 13A, 13B and 13C are graphs for showing operation of the third embodiment shown in FIG. 12, FIGS. 14 and 15 are graphs for showing other examples of the musical tone waveshapes to be generated by the electronic musical instrument in accordance with the present invention.
Figure 13B:
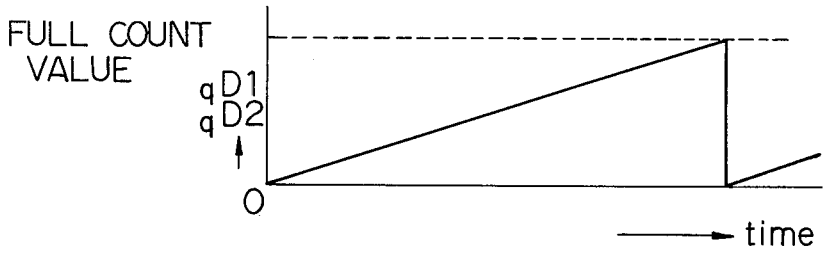
Figure 13C:
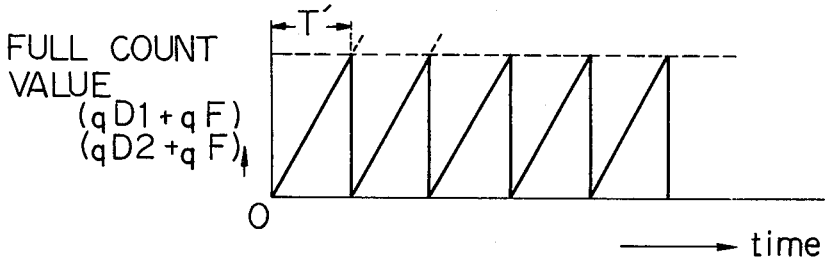

The parameter signals D1 and D2 are generally smaller in value than the frequency informations F stored in the frequency information memory 2 of the first musical tone waveshape generating unit 101. The length of time needed by the accumulated values qF of the accumulator 3 to reach the full count value is smaller, as shown in FIGS. 13A and 13B, than the length of time needed by either of the accumulated values qD1 and qD2 of the accumulator 44 to reach the full count value. Consequently, either of the added values ($qD1+qF$) and ($qD2+qF$) of the adder 46 reaches the full count value within a period T' which is shorter, as shown in FIGS. 13A and 13C, than the period T needed by the accumulated value qF of the accumulator 3 to reach the full count value. As a result, the second musical tone waveshape MW2 generated by the generator 47 is higher in frequency than the first musical tone waveshape MW1 generated by the generator 48. By addition of the two musical tone waveshapes MW1 and MW2, a new musical tone waveshape MW is generated in order to generate a corresponding musical tone which accompanies the chorus effect.

(iii)'' Under the fourth condition in which the movable contact p of the switch SW1 is put into contact with the fixed contact d whereas the movable contact p of the switch SW2 is kept in contact with the fixed contact c.

Under this condition, a signal "logic 1" appears on one output line of the keyboard circuit 1 when a certain key is operated in the keyboard in order to be passed to the frequency information memory 41 of the second musical tone waveshape generating unit 102. A number of frequency informations F' each corresponding to the tonal pitch of the associated key are stored in different addresses of the frequency information memory 41, respectively. The frequency information memory 41 therefore generates frequency information F' corresponding to the operated key, which are then passed to the input side of the accumulator 44 via the switch SW2. Upon receipt of the clock pulse signal $\phi$, the accumulator 44 sequentially accumulates the applied frequency information F' and passes the accumulated values qF' ($q=1, 2, 3 \ldots$) to the one input terminal A of the adder 46 via the switch SW1. Concurrently with this procedure, the accumulated values qF from the accumulator 3 of the first musical tone generating unit 101 are applied to the other input terminal B of the adder 46. Consequently, the adder 46 generates added values (qF'+qF).

The frequency informations F' stored in the memory 41 are smaller in value than the frequency informations F stored in the memory 2. Consequently, the length of time needed by the accumulated value qF to reach the full count value is smaller than the length of time needed by the accumulated value qF' to reach the full count value just like under the third condition. Further, as described already, the accumulator 3, the accumulator 44 and the adder 46 are common in full count value to each other. The added values (qF'+qF) generated by the adder 46 do never exceed this full count value. Therefore, just like under the third condition, each added value (qF'+qF) reaches the full count value within a period T' which is shorter, as shown in FIG. 13A and 13C, than the period T needed by the accumulated value qF of the accumulator 3 to reach the full count value. Since different frequency informations F' are generated by the memory 41 for different operated keys, the period T' varies from key to key. As a result, the second musical tone waveshape MW2 generated by the generator 47 is lower in frequency than the first musical tone waveshape MW1 generated by the memory 48, and the frequencies vary from key to key. The musical tone waveshapes MW1 and MW2 are added to each other at the adder 49 for generation of a new corresponding musical tone waveshape MW which shall be further passed to the digital-analog converter 10 and the sound system 11. Different chorus effects can be obtained under this condition for different operated keys.

(iii)''' Under the fifth condition in which the movable contact p of the switch SW1 is put into contact with the fixed contact d whereas the movable contact p of the switch SW2 is kept in contact with the fixed contact d.

Under this condition, frequency informations F' corresponding to the operated key are read out from the frequency information memory 41 and, concurrently with this procedure, the parameter signal generator 42 generates a time-functional parameter signal D(t) upon receipt of the key-on signal KON taken from the keyboard circuit 1. Each frequency information F' is multiplied by the parameter signal D(t) at the multiplier 43 so that each multiplied value F'D(t) shall be applied to the input side of the accumulator 44 via the switch SW2. The accumulator 44 sequentially accumulates the multiplied values F'D(t) upon receipt of the clock pulse signals $\phi$ in order to generate accumulated values qF'D(t) (q=1, 2, 3 . . . ). Each accumulated value qF'D(t) is then passed to the one input terminal A of the adder 46. Each accumulated values qF from the accumulator 3 of the first musical tone waveshape generating unit 101 is concurrently applied to the other input terminal B of the adder 46. Thus, the adder 46 generates added values {qF'D(t)+qF}.

In connection with this, it should be noted that the frequency informations F' stored at the memory 41 are in general smaller in value than the frequency informations F stored at the memory 2, and that the time functional parameter signals D(t) are in general small in value. The length of time needed by the accumulated values qF of the accumulator 3 to reach the full count value is longer than that needed by the accumulated values qF'D(t) of the accumulator 44 to reach the full count value just like under the third and fourth conditions (see FIGS. 13A and 13B). Farther, since the accumulators 3 and 44 and the adder 46 are common in full count value to each other, each added value (qF'+qF) does never exceed this full count value. Consequently, just like under the third and fourth conditions (see FIGS. 13A and 13C), each added value (qF'+qF) of the adder 46 reaches the full count value within a period T' which is shorter than the period T for each accumulated value qF of the accumulator 3 to reach the full count value. The period T' varies from key to key, since different frequency informations F' are generated by the memory 41 for different operated keys. Further, as the parameter signal D(t) varies with time, the period T' varies with time also.

Consequently, the second musical tone waveshape MW2 from the generator 47 of the second unit 102 is lower in frequency than the first musical tone waveshape MW1 from the generator 48 of the first unit 101, and the frequency thereof varies with key and time. A new musical tone waveshape MW is generated by the adder 49 via addition of these waveshapes MW1 and MW2. A time-functional chorus effect is obtained under this condition, which varies in extent from key to key.

In accordance with the above-described third embodiment of the present invention, it is possible to greatly reduce the number of arithmetic circuits such as multipliers and adders and to provide electronic musical instrument with greatly reduced cost in which generated musical tones are accompanied with a wide variety of rich chorus effects.

Figure 14:
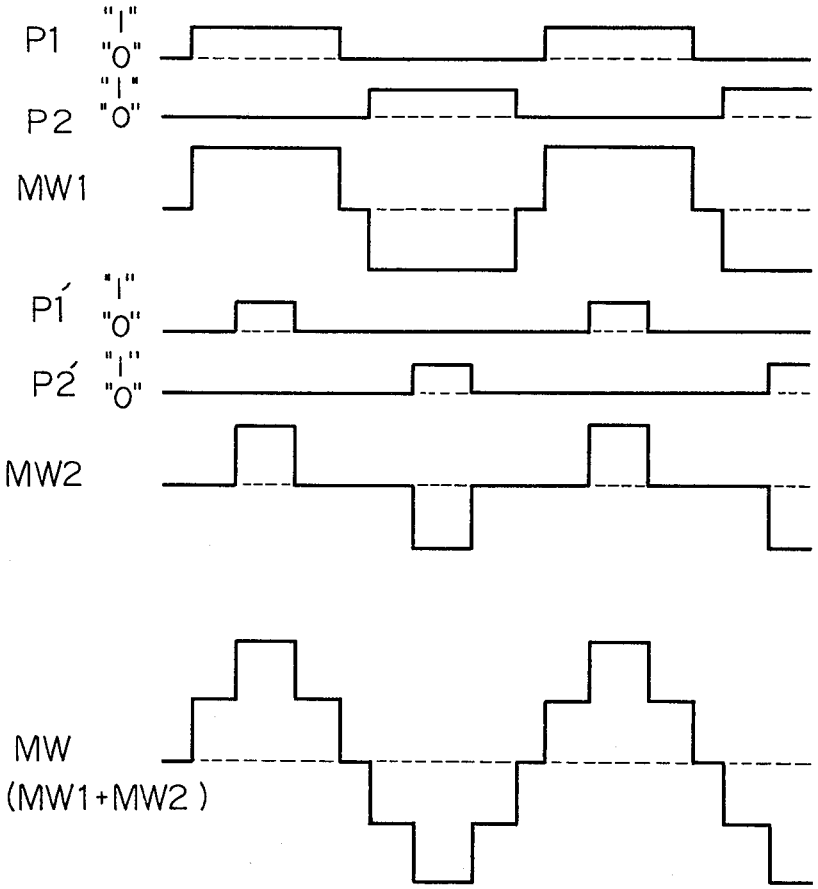

FIG. 14 shows a manner of generating various musical tones by adjusting the number of harmonic tones to be contained in each musical tone.

In breif, two pulse signals P1 and P2 are generated, each having a frequency corresponding to the tonal pitch of the operated key. On the basis of these pulse signals P1 and P2, sampling is executed on an envelope waveshape generated upon key operation and the sample values are inverted from positive to negative at the timing of the one pulse signal P2 in order to obtain a musical tone waveshape MW1 such as shown in FIG. 14. This process can be carried out with the arrangement shown in FIG. 4. In FIG. 14, a very short time scale is given to the abscissa, whereby the value of the envelope waveshape shows very little change only so that the maximum amplitude of the musical tone waveshape MW1 remains almost constant.

Concurrently with the above-described procedure, two pulse signals P1' and P2' are generated also, each having a frequency corresponding to the tonal pitch of the operated key. On the basis of these pulse signals P1' and P2', sampling is execited pm an envelope waveshape generated upon key operation and the sample values are inverted from positive to negative at the timing of the one pulse signal P2' in order to obtain a musical tone waveshape MW2 such as shown in FIG. 14. Like generation of the above-described musical tone waveshape MW1, this process can be carried out with the arrangement shown in FIG. 4. Since the time axis for this waveshape MW2 is same with that for the waveshape MW1, the maximum and minimum amplitudes of the musical tone waveshape MW2 remain constant, also.

By addition of the waveshapes MW1 and MW2, a new musical tone waveshape MW is formed as shown in FIG. 14. Since this waveshape MW takes the form of a sine curve, this generates a musical tone of relatively small number of harmonic tones.

In order to compose the musical tone waveshape MW shown in FIG. 14 in practice, a circuit including the pulse signal generating circuits 4 and 5, the envelope waveshape 6, the exclusive-OR-circuit 7, the gate circuit 8 and the amplitude converter 9 shown in FIG. 4 is used for the musical tone waveshape generators 48 and 47 shown in FIG. 12.

Figure 15:
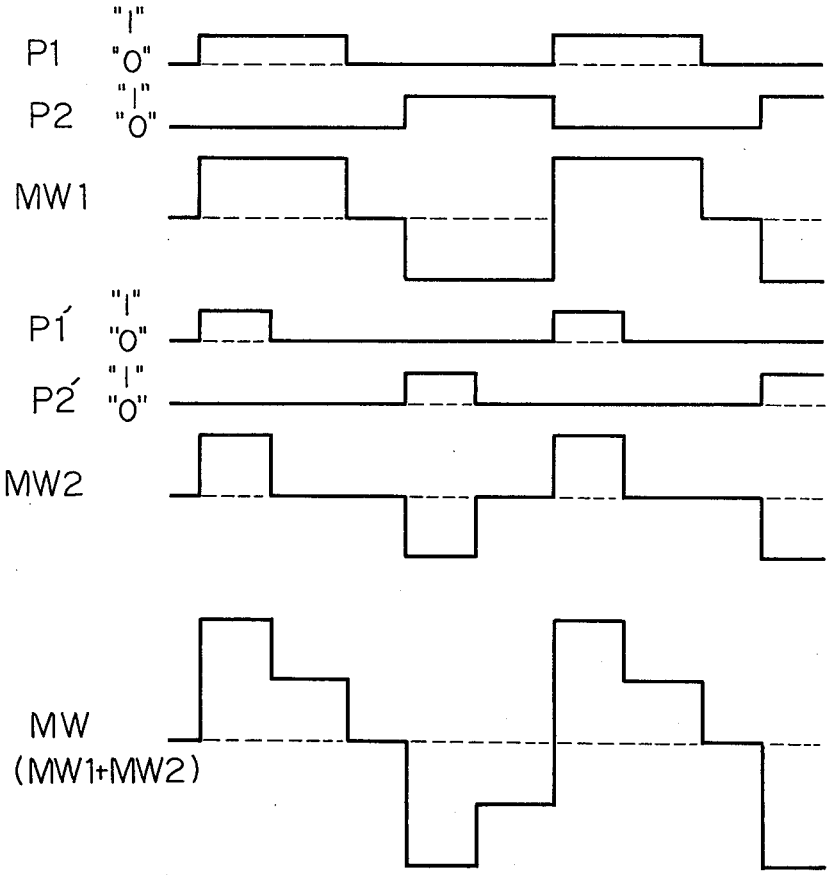

Two pulse signals P1 and P2 shown in FIG. 15 are generated, each having a frequency corresponding to the tonal pitch of the operated key. On the basis of those pulse signals P1 and P2, sampling is executed on an envelope waveshape generated upon key operation and the sample values are inverted from positive to negative at the timing of the one pulse signal P2 in order to form a musical tone waveshape MW1 such as shown in FIG. 15. This process can be carried out with the arrangement shown in FIG. 4, also. In FIG. 15, a very short time scale is given to the abscissa.

Concurrently with the above-described procedure, two pulse signals P1′ and P2′ are generated, each having a frequency corresponding to the total pitch of the operated key On the basis of these pulse signals P1′ and P2′, sampling is applied to an envelope waveshape generated upon key operation and the sample values are inverted from positive to negative at the timing of the one pulse signal P2′ in order to produce a musical tone waveshape MW2 such as shown in FIG. 15. Like generation of the above-described musical tone waveshape MW1, this process can be practiced with the construction shown in FIG. 4. The time axis for this waveshape MW2 is same with that for the waveshape MW1.

By addition of the waveshapes MW1 and MW2, a new musical tone waveshape MW is obtained as shown in FIG. 15, which is given in the form of a saw-tooth shape. The musical tone generated from this waveshape MW therefore is of relatively large number of harmonic tones.

In order to compose the musical tone waveshape MW shown in FIG. 15 in practice, a circuit including the pulse signal generating circuits 4 and 5, the envelope waveshape generator 6, the exclusive-OR-circuit 7, the gate circuit 8 and the amplitude converter 9 in FIG. 4 can be used for the musical tone waveshape generators 48 and 47 shown in FIG. 12.

The present invention is characterized in that a plurality of pulse signals, e.g. P1 and P2, are generated each having a frequency corresponding to the tonal pitch of the operated key, sampling is executed on an envelope waveshape EV generated upon key operation on the basis of these pulse signals, and the sample values are inverted in amplitude from positive to negative or vice versa in reference to the pulse signals. Due to this process speciality, the generated musical tone waveshapes MW vary stepwise with time as shown in FIGS. 8. 14 and 15. The illustration in FIG. 8 is given rather in a schematic fashion and the musical tone waveshapes MW in practice have by far high frequencies. As the stepwise varying musical tone waveshapes MW are further processed through the digital-analog converter 10 and the sound system 11, the generated musical tones tend to contain so-call "reflected frequency noises" ("aliasing noises") which should preferably be eliminated for ideal generation of musical tones.

Assuming that the data rate for the musical tone waveshape MW is designated with "fs", frequency components in the waveshape MW above fs/2 are reflected with respect to the frequency fs/2 as the axis of symmetry to cause generation of undesirable noises.

Figure 16:
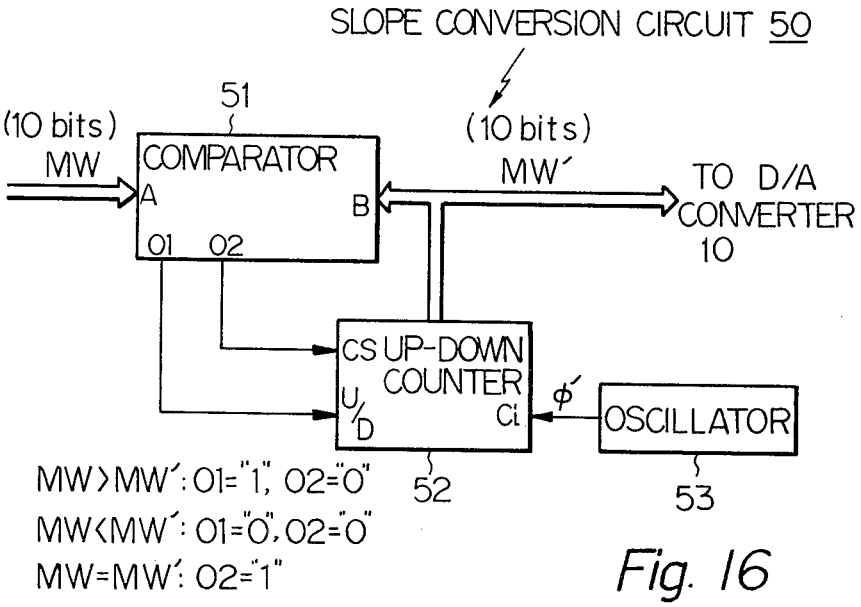
FIG. 16 is a block diagram for one example of the slope conversion circuit used for elimination of reflected-frequency noises in the electronic musical instrument in accordance with the present invention.

A slope conversion circuit 50 shown in FIG. 16 is effectively used for eliminating noises of the above-described sort. This circuit 50 is to be coupled to the input side of the digital-analog converter 10. That is, the circuit 50 is interposed between the amplitude converter 9 and the digital-analog converter 10 in the first and second embodiments shown in FIGS. 4 and 10 whereas same should be inserted between the adder 49 and the digital-analog converter 10 in the third embodiment shown in FIG. 12.

As shown in FIG. 16, the slope conversion circuit 50 includes a comparator 51 having two input terminals A and B, an up-down counter 52 coupled to the comparator 51, and an oscillator 53 accompanying the counter 52. A 10-bit musical tone waveshape MW is applied to the first input terminal A of the comparator 51 whose second input terminal B receives a 10-bit converted musical tone waveshape MW′ from the up-down counter 52, the latter being a count value of the counter 52.

The comparator 51 generates at the first output signal 01 a signal "logic 1" when the waveshape MW is larger in value than the waveshape MW′, a signal "logic 0" when the waveshape MW is smaller than the waveshape MW′, and, at the second output terminal 02, a signal "logic 1" only when the waveshapes MW and MW′ are equal to each other.

The first output terminal 01 of the comparator 51 is coupled to the up-down command terminal U/D of the up-down counter 52 whereas its second output terminal 02 is coupled to the count stop command terminal CS of the counter 52. The count input terminal Ci of the counter 52 receives a clock pulse signal $\phi'$ from the oscillator 53.

The up-down counter 52 ceases its counting operation when a signal "logic 1" is applied to its count stop command terminal CS. The up-down counter 52 is set in the count-up mode in order to sequentially count up the clock pulse signal $\phi'$ passed to its count input terminal Ci when a signal "logic 0" is applied to its count stop command terminal CS and a signal "logic 1" is applied to its up-down command terminal U/D. In contrast to this, the up-down counter 52 is set in the count-down mode in order to sequentially count down the clock pulse signal $\phi'$ passed to its count input terminal Ci when a signal "logic 0" is applied to its count stop command terminal CS and a signal "logic 0" is applied to its up-down command terminal U/D.

The up-down counter 52 generates its count values in the form of 10-bit converted musical tone waveshapes MW′ which are in turn applied to the input terminal B of the comparator 51. The frequency of the clock pulse signal $\phi'$ generated by the oscillator 53 should be sufficiently higher than the varying frequency of the musical tone waveshape MW.

Operation of the slope conversion circuit 50 with the above-described construction is as follows.

Figure 17A:
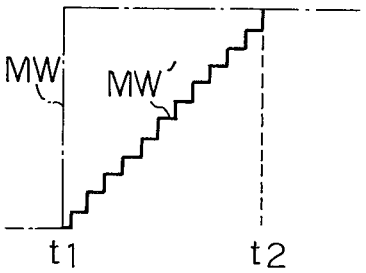
FIGS. 17A and 17B are graphs for showing operation of the slove conversion circuit shown in FIG. 16.

When the musical tone waveshape MW increases large-stepwise in value as shown in FIG. 17A, a signal "logic 1" is generated at the first output terminal 01 of the comparator 51 and a signal "logic 0" is generated at the second output terminal 02, both at the timing t1. Consequently, the signal "logic 0" is applied to the count stop command terminal CS of the up-donw counter 52 whereas the signal "logic 1" is applied to its up-down command terminal U/D. As a result of this, the counter 52 is set in the count-up mode in order to sequentially count up the clock pulse signal $\phi'$ passed to its count input terminal Ci, whereby the counter 52 generates count values as the 10-bit converted musical tone waveshapes MW'. The waveshape MW' gradually increases in value as the counting-up operation advances in the counter 52 in order to reach the value of the musical tone waveshape MW at the timing t2 in FIG. 17A. Then, a signal "logic 1" appears at the second output terminal 02 of the comparator 51 so that the up-down counter 52 provisionally ceases its counting operation upon receipt of this signal at the count stop command terminal CS.

Figure 17B:
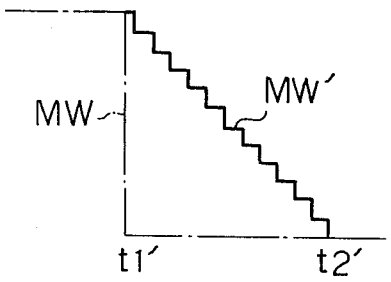

When the musical tone waveshape MW decreases large-stepwise in value as shown in FIG. 17B, signals "logic 0" are generated at the first and second output terminals 01 and 02 of the comparator 51 at the timing t1'. The signals "logic 0" are applied to the count stop command and up-down command terminals CS and U/D of the up-down counter 52 which is then set to the count-down mode in order to sequentially count down the clock pulse signal $\phi$ passed to its count input terminal Ci. Then, the counter 52 generate count values as the 10-bit converted musical tone waveshapes MW' which gradually decreases in value as the counting operation advances in the counter 52 and reaches the value of the musical tone waveshape MW at the timing t2' in FIG. 17B. Then a signal "logic 1" appears at the second output terminal 02 of the comparator 51 so that the up-down counter 52 provisionally ceases its counting operation upon receipt of this signal at the count stop command terminal CS.

Use of the circuit 50 shown in FIG. 16 enables conversion of an abruptly changing musical tone waveshape MW into a corresponding gradually changing conversed musical tone waveshape MW', thereby producing musical tones with greatly reduced reflected frequency noises. In particular, since the varying rate of the musical tone waveshape MW is very high when a key of a high tonal pitch is operated, the slope conversion circuit 50 acts very effectively in order to greatly minimize the reflected frequenct noises.

It will be clearly undrstood from the foregoing description that employment of the present invention enables provision of electronic musical instruments of high quality and excellent function even with use of reduced number of arithmetic circuit such as multipliers and adders.

I claim:

1. An electronic musical instrument comprising:

keyboard means including keys to be operated for musical performance;

a pulse signal generating circuit connected to said keyboard means and for generating a pluality of pulse trains of a same frequency corresponding to the tonal pitch of the operated key but of different phases, each said pulse train being constituted by "logic 1's" and "logic 0's";

an envelope waveshape generator connected to said keyboard means and for generating an envelope waveshape having a selected polarity upon every key operation; and musical tone waveshape generating means for sampling said envelope wavehshape and selectively reversing the polarity of sampled values therefrom, said musical tone waveshape generating means being connected to said pulse signal generating circuit and to said envelope waveshape generator, and sampling said envelope waveshape as a function of said pulse trains applied thereto, and said musical tone waveshape generating means further acting to reverse the polarity of sampled values of said envelope waveshape as a function of said pulse trains.

2. An electronic musical instrument as claimed in claim 1 in which said musical tone waveshape generating means includes:

exclusive-OR-circuit means connected to said pulse signal generating circuit;

a gate circuit connected to said exclusive-OR-circuit means and to said envelope waveshape generator, said gate circuit being enabled upon receipt of a "logic 1" signal from said exclusive-OR-circuit means; and amplitude converter means connected to said pulse signal generating circuit and to said gate circuit, said amplitude converter means acting to selectively reverse said polarity of sampled values of said envelope waveshape supplied by said gate circuit upon receipt of at least one of said pulse trains from said pulse signal generating circuit.

3. An electronic musical instrument as claimed in claim 2 in which said musical tone waveshape generating means further includes:

a slope conversion circuit connected to said amplitude converter means, said slope conversion circuit being responsive to abrupt shifts in value of a musical tone waveshape from said amplitude converter means to convert said abrupt shifts to more gradual shifts in value of said musical tone.

4. An electronic musical instrument comprising:

keyboard means including keys to be operated for musical performance;

a first musical tone waveshape generating unit including;

a first pulse signal generating circuit connected to said keyboard means and for generating a plurality of first pulse trains of a same frequency corresponding to the tonal pitch of the operated key but of different phases, each said pulse trains being constituted by "logic 1's" and "logic 0's", a first envelope waveshape generator connected to said keyboard means and for generating a first envelope waveshape having a selected polarity upon every key operation, and a first musical tone waveshape generating means for sampling said first envelope waveshape and selectively reversing the polarity of sampled values therefrom, said first musical tone waveshape generating means being connected to said first pulse signal generating circuit and said first envelope waveshape generator and sampling said first envelope waveshape as a function of said first pulse trains applied thereto, said first musical tone waveshape generating means further acting to reverse the polarity of sampled values of said first envelope waveshape as a function of said first trains; and a second musical tone waveshape generating unit including;

a parameter signal generator connected to said keyboard means and for generating a parameter signal, a second pulse signal generating circuit connected to said first pulse signal generating circuit and to said parameter signal generator and for generating a plurality of second pulse trains of a same frequency corresponding to the tonal pitch of the operated key but of either phases or frequencies different from each corresponding first pulse train according to said parameter signal, each said second pulse train being constituted by "logic 1's" and "logic 0's", a second waveshape generator connected to said keyboard means and for generating a second waveshape having a selected polarity upon every key operation, and a second musical tone waveshape generating means for sampling said second envelope waveshape and selectively reversing the polarity of the sampled values therefrom, said second musical tone waveshape means being connected to said second pulse signal generating circuit and said second envelope waveshape generator and sampling said second envelope waveshape as a function of said second pulse trains applied thereto, said second musical tone waveshape generating means further acting to reverse the polarity of sampled values of said second envelope waveshape as a function of said second pulse trains.

5. An electronic musical instrument as claimed in claim 4 in which said first musical tone waveshape generating means includes:

a first exclusive-OR-circuit means connected to said first pulse signal generating circuit, a first gate circuit connected to said first exclusive-OR-circuit means and to said first envelope waveshape generator, said first gate circuit being enabled upon receipt of a "logic 1" signal from said first exclusive-OR-circuit means, and first amplitude converter means connected to said first pulse signal generating circuit and to said first gate circuit, said first amplitude converter means acting to selectively reverse said polarity of sampled values of said first envelope waveshape supplied by said first gate circuit upon receipt of at least one of said pulse trains from said first pulse signal generating circuit; and said second musical tone waveshape generating means includes;

a second exclusive-OR-circuit means connected to said second pulse generating circuit, a second gate circuit connected to said second exclusive-OR-circuit means and to said second envelope waveshape generator, said second gate circuit being enabled upon receipt of a "logic 1" signal from said second exclusive-OR-circuit means, and second amplitude converter means connected to said second pulse generating circuit, a second gate circuit connected to said second exclusive-OR-circuit means and to said second envelope waveshape generator, said second gate circuit being enabled upon receipt of a "logic 1"signal from said second exclusive-OR-circuit means, and second amplitude converter means connected to said second pulse signal generating circuit and to said second gate circuit, said second amplitude converter means acting to selectively reverse said polarity of sampled values of said second waveshape supplied by said second gate circuit upon receipt of at least one of said pulse trains from said second pulse signal generating circuit.

6. An electronic musical instrument as claimed in claim 5 in which said first musical tone waveshape generating means further includes:

a first slope conversion circuit connected to said first amplitude converter means, said first slope conversion circuit being responsive to abrupt shifts in value of a musical tone waveshape from said first amplitude converter means to convert said abrupt shifts to more gradual shifts in value of said musical tone; and said second musical tone waveshape generating means further includes:

a second slope conversion circuit to said second amplitude converter means, said second slope conversion circuit being responsive to abrupt shifts in value of a musical tone waveshape from said second amplitude converter means to convert said abrupt shifts to more gradual shifts in value of said musical tone.

7. An electronic musical instrument as claimed in claim 4 said parameteter signal varies with time.

8. An electronic musical instrument as claimed in claim 1 or 4 in which each said pulse signal generating circuit includes a keyboard circuit having a number of output lines each corresponding to a key in the keyboard, a frequency information memory coupled to said keyboard circuit and having a number of addresses each storing a value of frequency information corresponding to respective ones of the keys in said keyboard, an accumulator coupled to said frequency information memory, said accumulator sequentially accumulating frequency informations supplied by said frequency information memory in response to key operation, first pulse signal generator means coupled to said accumulator for generating a first pulse signal having a frequency exhibiting a tonal pitch of an operated key, and second pulse signal generator means coupled to said accumulator for generating a second pulse signal having a frequency exhibiting a tonal pitch of said operated key, said second pulse signal differing in phase from said first pulse signal.

9. An electronic musical instrument as claimed in claim 1 or 4 in which each said pulse signal generating circuit includes:

a first parameter signal generator for generating a first parameter signal, a second parameter signal generator for generating a second parameter signal, a third parameter signal generator for generating a third parameter signal, a keyboard circuit having a number of output lines each corresponding to a key in the keyboard, a frequency information memory coupled to said keyboard circuit and having a number of addresses each storing a value of frequency information corresponding to respective ones of the keys in said keyboard, an accumulator coupled to said frequency information memory for sequentially accumulating frequency information supplied by said frequency information memory in response to key operation, a first adder coupled to said accumulator and said first parameter signal generator for carrying out addition between each accumulated value and said first parameter signal, a second adder coupled to said first adder and said second parameter signal generator for adding each output value from said first adder and said second parameter signal, a subtractor coupled to said second adder and said third parameter signal generator for carrying out subtraction between each output value from said second adder and said third parameter signal, first pulse signal generator means coupled to said second adder for generating a first pulse signal having a frequency exhibiting a tonal pitch of said operated key, second pulse signal generator means coupled to said subtractor for generating a second pulse signal having a frequency exhibiting a tonal pitch of said operated key, said second pulse signal differing in phase from said first pulse signal by a value corresponding to said third parameter signal, third pulse signal generator means coupled to said first adder for generating a third pulse signal having a frequency exhibiting a tonal pitch of said operated key, said third pulse signal differing in phase from said first pulse signal by a value corresponding to said second parameter signal, and fourth signal generator means coupled to said accumulator for generating a fourth pulse signal having a frequency exhibiting a tonal pitch of said operated key, said fourth pulse signal differing in phase from said third pulse signal by a value corresponding to said first parameter signal.

10. An electronic musical instrument as claimed in claim 9 in which each said parameter signal varies with time.

* * * * *